US008657132B2

(12) United States Patent
Benz et al.

(10) Patent No.: US 8,657,132 B2
(45) Date of Patent: Feb. 25, 2014

(54) BIN DIVIDER FOR USE IN A DOOR BIN

(75) Inventors: Thomas Benz, Neu-Ulm (DE); Matthew Ricket, New Bern, NC (US)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1268 days.

(21) Appl. No.: 11/290,746

(22) Filed: Nov. 30, 2005

(65) Prior Publication Data

US 2007/0119807 A1 May 31, 2007

(51) Int. Cl.
*A47F 5/00* (2006.01)

(52) U.S. Cl.
USPC ..... 211/184

(58) Field of Classification Search
USPC ..... 211/184, 11, 88.01, 42, 90.01, 43, 103, 211/44, 87.01, 207, 10, 59.4; 206/557, 561, 206/564, 373; 202/529, 530, 532
See application file for complete search history.

(56) References Cited

U.S. PATENT DOCUMENTS

| | | | | | |
|---|---|---|---|---|---|
| 2,087,149 | A * | 7/1937 | Granville | 211/162 |
| 2,688,409 | A * | 9/1954 | Echlin | 211/184 |
| 3,145,850 | A * | 8/1964 | Ciborowski | 211/133.5 |
| 3,857,492 | A * | 12/1974 | Michaelis et al. | 211/42 |
| 3,986,649 | A * | 10/1976 | Heimstra | 224/567 |
| 4,552,272 | A * | 11/1985 | Field | 211/88.01 |
| 4,735,324 | A * | 4/1988 | Wilcek | 211/184 |
| 5,439,123 | A * | 8/1995 | Nook | 211/187 |
| 5,555,990 | A * | 9/1996 | Bechstein | 211/59.3 |
| 5,765,390 | A * | 6/1998 | Johnson et al. | 62/441 |
| 5,927,840 | A * | 7/1999 | Bzowski | 312/321.5 |
| 6,164,215 | A * | 12/2000 | Cook et al. | 108/60 |
| 6,305,559 | B1 * | 10/2001 | Hardy | 211/184 |
| 6,666,342 | B1 * | 12/2003 | House | 211/70.6 |
| 6,880,903 | B2 * | 4/2005 | O'Halloran et al. | 312/407 |
| 7,229,143 | B2 * | 6/2007 | Gilman | 312/405.1 |
| 2006/0049125 | A1 * | 3/2006 | Stowell | 211/184 |
| 2006/0278596 | A1 * | 12/2006 | Parshad | 211/184 |
| 2007/0175845 | A1 * | 8/2007 | Hardy | 211/184 |

* cited by examiner

*Primary Examiner* — Katherine Mitchell
*Assistant Examiner* — Candace L Bradford
(74) *Attorney, Agent, or Firm* — James E. Howard; Andre Pallapies

(57) ABSTRACT

A moveable bin divider is provided for use in a door bin. The divider includes a divider plate extending at least a portion of the width and depth of a bin within which it is used. The divider plate includes a panel integral and perpendicular thereto which extends vertically and includes a first portion connected by a bridge over a wall of a bin with which it is used to a second portion which terminates at an engagement mechanism such as a tongue or groove. The engagement mechanism is received or receives a corresponding tongue or groove on a wall of a bin in which the bin divider is received for securely holding the divider within the bin. The engagement mechanism is biased against the bin wall to prevent undesired movement of the moveable bin divider. A combination bin and bin divider is also provided.

12 Claims, 4 Drawing Sheets

BIN DIVIDER FOR USE IN A DOOR BIN

FIELD OF THE INVENTION

This invention relates to a moveable bin divider for use in a door bin, and which is constructed for being moved and held in rigid engagement with a bin to securely divide the bin into at least two, and optimally more than two (multiple) storage regions. More specifically, the invention relates to such a bin divider and a combination of a bin with such a moveable bin divider for use, in particular, in a bin supported on the inside wall of a door of a storage compartment such as a refrigerator.

BACKGROUND OF THE INVENTION

Bins have been known for use in storage compartments, such as, for example, in refrigerators for many years. Such bins are typically used for storing smaller articles and/or selected specialty articles such as milk bottles, jam bottles, ketchup bottles, etc. and other like small items which are desired to be easily reached when searching for an item, for example, which is stored in a refrigerator.

In the past, such bins have been supported against the inside wall of at least one door of a refrigerator, for example, in secure engagement through a number of securing mechanisms. Typically, in many cases such bins are mounted on an inner wall thereof flush against the inner wall of the refrigerator door. In more recent times, it has become desirable to provide dividers for sectioning off different sections of the bin such that, for example, smaller items can be stored in a smaller section without becoming mixed with larger items and therefore becoming more difficult to access. The bin divider can be separate from or integral with the bin. Clearly, integral dividers allow the user no flexibility in the divider location.

A problem with moveable arrangements has often been however, that there is no way to conveniently and securely attach a moveable bin divider within the bin in a manner where the bin divider does not move and is tightly engaged by the bin. Examples of such arrangements include and are not limited to dividers, which overlap a front wall of the bin in sliding engagement. Any jostling of items as a result of opening and closing the refrigerator door will result in movement of the bin divider if the bin is not completely filled, such that an attempt at defining a precise divided space within the bin is frustrated.

In accordance with the invention, these and other problems of the existing constructions are avoided.

BRIEF SUMMARY OF THE INVENTION

In accordance with one aspect of the invention, there is provided a moveable bin divider for use in a door bin. The divider includes a divider plate of a size for extending a length from the rear wall of a bin and through at least a portion of the depth thereof to divide the bin into storage sections. The bin with which the divider is used is of the type which is supported on an inner door of a storage compartment in a manner wherein the outside of a rear wall of the bin is spaced from the inner wall of the door on which it is supported. A panel is integral with the divider plate at a rear thereof and is perpendicular thereto. The panel includes a first portion extending vertically at least above the height of a rear wall of a bin in which it is used, with a bridge portion extending over a rear wall of the bin and connecting a second portion of the panel to the first portion to have the second portion parallel and partly coextensive with the first portion, on the outside of the rear wall of the bin. The second portion terminates at the bottom end in one of a tongue or groove integral therewith to be engaged in a respective corresponding one of a groove and tongue located on the outside rear wall of the bin with which it is engaged.

In one aspect, the one of a tongue and groove at the end of the second portion is a tongue, with the corresponding one of a groove and tongue on the bin being a groove. Alternatively, the reverse arrangement can be provided.

The bridge portion is sized to have the first portion and the second portion be biased in physical contact with a wall of the bin with which it is used, on both sides of the wall. In this manner, by engagement between the respective tongue and grooves of the second portions and outside portion of the bin wall, combined with the physical contact between the portions of the divider and the wall of the bin, a secure and relatively non-moveable engagement, except when a user actually exerts a physical force thereon to move the divider, is accomplished resulting in a secure but removable, where desired, bin divider and bin arrangement.

In another aspect, there is provided a combination bin and bin divider for the door of a storage compartment substantially in a manner described previously, with the bin having either a tongue or groove at the rear thereof in engagement with a corresponding one of a groove or tongue at the end of the second portion of the panel of the bin divider. In another aspect, the storage compartment is a refrigerator.

BRIEF DESCRIPTION OF THE SEVERAL VIEWS OF THE DRAWING

Having thus briefly described the invention, the same will become better understood from the following detailed description made with reference to the several views of the drawing, wherein.

DETAILED DESCRIPTION OF THE INVENTION

Figure 1:
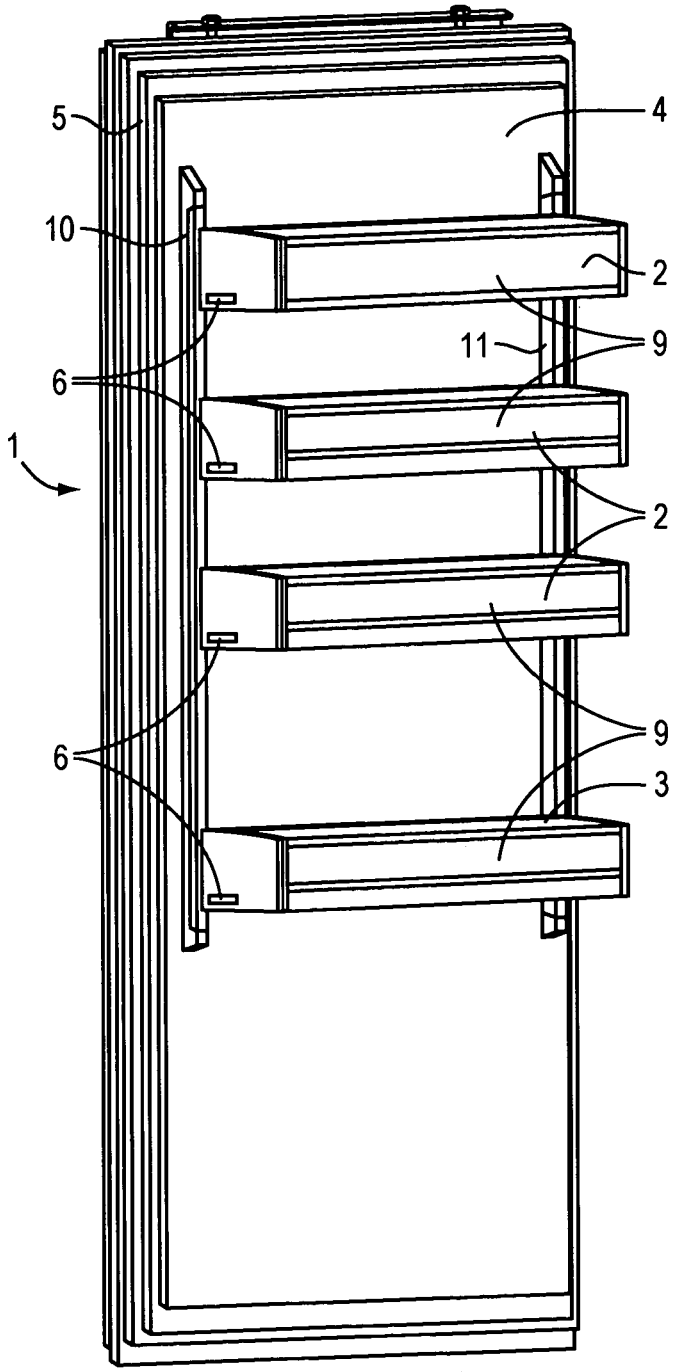
FIG. 1 is a perspective view of a refrigerator door with bins attached in the inside wall thereof in a spaced arrangement from the inside wall of the door.

FIG. 1 illustrates a refrigerator door 1 having an inner wall 4 and a door seal 5 with two supporting members 10 each having facing walls 11, with bins 2 with an inner storage area 3, supported thereon. The bin 2 includes a front wall 9.

Figure 2:
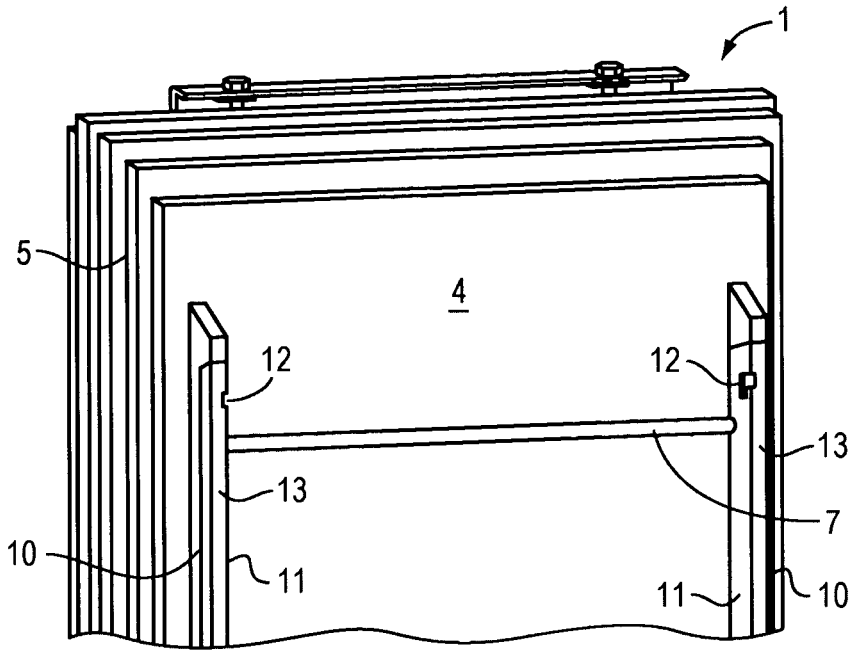
FIG. 2 is an enlarged partial view of the inside of a refrigerator door showing a support mechanism for bins held thereon.

FIG. 2 is an enlarged partial view of a section of the door shown in FIG. 1. An inside wall 4 of the door is shown with seals 5 around the edges thereof for sealing the refrigerator door 1 when closed. A pair of bin support members 10 have side faces 11 facing each other and front faces 13 facing in a perpendicular direction relative to side faces 11. The faces 10 and 13 are attached to the inside 4 of the refrigerator door 1. Door retaining slots 12 serve to engage with the bins 2 and a spacing bar 7 is attached to the support members 10 or to the inner wall 4 at appropriate locations to ensure that the bins 2 are held in a proper position relative to the inner wall 4 of the door 1.

Figure 3:
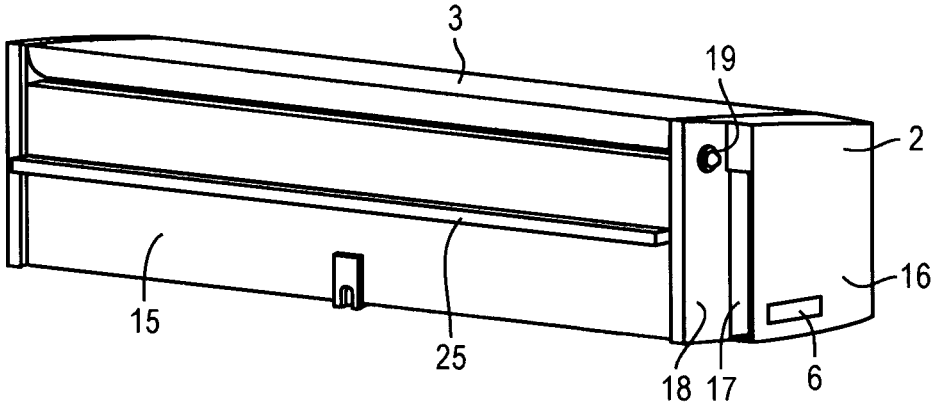
FIG. 3 is a rear perspective view of one embodiment of a bin for use with one embodiment of a divider in accordance with the invention.
Figure 4:
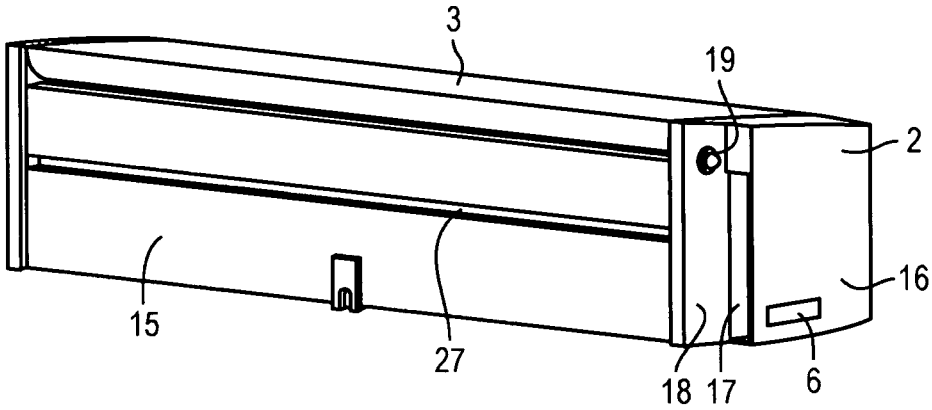
FIG. 4 is a rear perspective view as in FIG. 3 of an alternative embodiment of a bin for use with another embodiment of the divider of the invention.

More specifically, as shown in FIG. 3, the bin 2 has a pair of side walls 16, which each terminate at a rear facing wall 17 with a second sidewall 18 recessed inwardly from sidewall 16 and connecting to sidewall 16 through the wall 17. A pair of lugs 19 extend through sidewall 18 and are optimally connected through a rod (not illustrated) extending along the back of the bin 2. Alternatively, the lugs 19 can be connected simply at the respective walls 18 and not connected to each other through the rod extending along the rear wall 15 of the bin 2, through the recessed sidewall 18. The bin 2 includes an interior portion 3 for storing articles, and in the case of FIG. 3, a tongue 25 extending at least along a portion of the outside of rear wall 15 thereof, if not along the entire rear wall 15. While shown as a tongue 25, in an alternative construction as shown in FIG. 4, it can be a groove 27 which will operate with respect to a divider 33 for the bin interior 3 as will be described in greater detail hereinafter. One or more of the side walls 16 can include a plate or a logo 6.

In order to mount the bins 2 and the support member 10, the lugs 19 are received in slots 12 in a manner such that the rear face 17 of sidewall 16 abuts against front walls 13 with sidewall 18 facing sidewalls 11 of the supporting members 10. The spacing bar 7 abuts against the rear wall of sidewalls 18 to assist in having the bins 2 in relatively horizontal position without contacting the inner wall 4, and maintaining a space between the outside 15 of the rear wall of the bin 2 and the inner wall 4 of the refrigerating door 1, so that a moveable or adjustable bin divider 31 as shown in FIG. 5, can be received at the interior 3 of the bin to divide the interior 3 into different storage sections, as desired by a user.

FIG. 4, as described previously, illustrates an alternative embodiment of the bin of FIG. 3, in this case, having a groove 27 extending at least along a portion of the rear thereof, if not along the entire rear wall 15 thereof.

Figure 5:
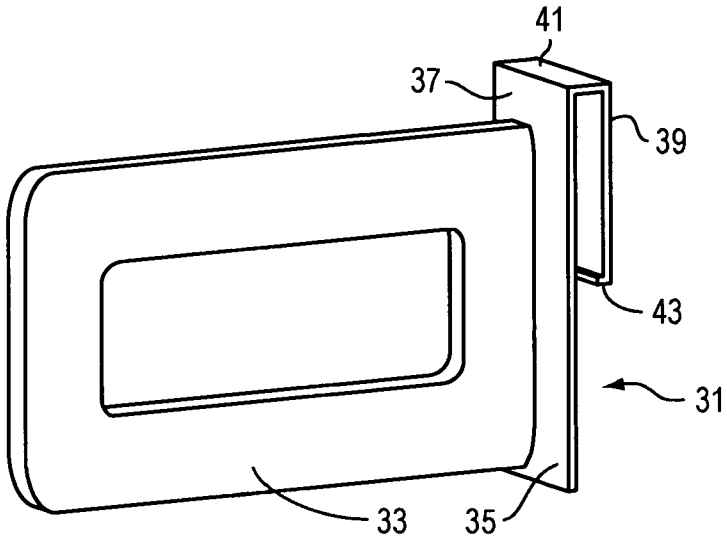
FIG. 5 is a perspective view of one embodiment of a bin divider in accordance with the invention.
Figure 6:
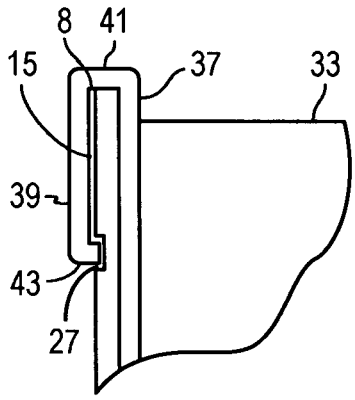
FIG. 6 is a partial view showing engagement between a bin divider in accordance with the invention showing one embodiment of engagement between the bin divider and the bin in which it is contained.
Figure 7:
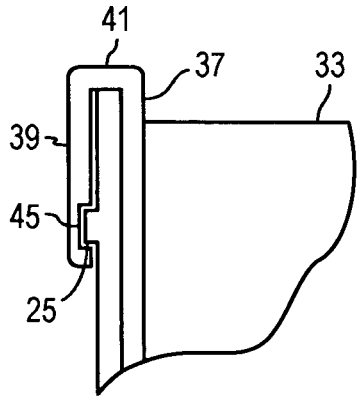
FIG. 7 is a view as in FIG. 6 of an alternative embodiment of the engagement between the bin divider and the bin.

The moveable divider 31 in accordance with the invention is illustrated in FIG. 5. A divider plate 33 is sized to extend perpendicularly from an inner rear wall of the interior 3 of the bin 2 through at least a portion of the depth and width of the bin 2, if not the entire depth and width. A panel 35 extends vertically in a perpendicular orientation to the divider plate 33 and integral therewith adjacent the inner rear wall of the interior of the bin 3. The panel 35 connects a first portion 37 of the panel 35 through a bridge portion 41, with a second portion 39 which is coextensive and substantially parallel with the first portion 37, and extends downwardly along the rear wall 15 on the outside of bin 2. Preferably an upper end 8 or the rear wall 15 fits and bears against the bridge portion 41. The second portion 39 terminates, in one embodiment at a tongue connection 43, which as illustrated in FIG. 6 serves to engage within a groove 27 of the rear wall 15 of the bin 2 to engage the divider 31 securely within the interior 3 of the bin. In an alternative embodiment, the second portion 39 terminates at a groove 45, which engages with a tongue 25 extending from the rear wall 15 of the bin 2.

In terms of preferred materials, as will be readily apparent to those of ordinary skill in the art, the divider 31 can be made of semi-flexible material similar to those for the bin 2 such as plastic material. The first portion 37, the bridge portion 41 and a second portion 39 preferably are shaped and dimensioned to provide a clamping force on the wall 15. The second portion 39 and bridge 41 are required to have some elasticity to be allowed to widen and be received over the back wall 15 of the bin 2 for engagement therewith. The dividing plate 33 can be pulled up by a user to disengage or slide the divider 31 along the bin 2 to remove or adjust the divider to a different lateral location in the bin 2. Such materials are well known to those of ordinary skill in the art and need not be explained in further detail herein.

Similarly, while a specific engagement arrangement has been shown for engaging the divider 31 with the bins 2 supported adjacent the inner wall 4 of a refrigerator door 1, it need not be limited to this specific arrangement and other alternative arrangements can be provided so long as a sufficient space is maintained between the rear wall 15 of the bin 2 and the inner wall 4 of the refrigerator door 1. Further, although not preferable, the divider can be engaged on the front wall 9 of the bin 2.

Finally, while the invention has been described in the context of a refrigerator and refrigerator bins, it will be appreciated by those of ordinary skill in the art that it need not be limited to refrigerators and can be implemented in any storage arrangement, such as a pantry, etc. in which a door is used to support bins in a spaced manner from the inner wall of the door, so that a bin and bin divider arrangement in accordance with the description herein can be employed.

Having thus generally described the invention, the same will become better understood from the claims which follow in which it is set forth in a non-limiting manner.

What is claimed is:

1. A moveable bin divider for use in a door bin, comprising:

a divider plate of a size for extending a length from a rear wall of a bin in which said divider plate is used to divide the bin into storage sections; and a panel integral with said divider plate at a rear end thereof and perpendicular thereto, said panel having a first portion extending vertically at least above the height of a rear wall of the bin, a bridge portion for extending over a rear wall of the bin and connecting a second portion of the panel to the first portion thereof to have the second portion parallel to and coextensive with at least a part of the first portion on an outside surface of the bin at a rear wall thereof, said second portion terminating at a bottom end thereof in one of a tongue and groove integral therewith to be engaged in a respective one of a tongue and groove in an outside rear wall of the bin in which it is engaged and the first portion having a height at least as great as the height of said divider plate.

2. The bin divider of claim 1, wherein said one of a tongue and groove at said bottom end of said second portion is a tongue.

3. The bin divider of claim 1, wherein said one of a tongue and groove at said bottom end of said second portion is a groove, said groove being formed by a pair of spaced apart walls each extending interiorly of a surface of said second portion that faces the respective outside surface of the rear wall of the bin and a base extending to and between said pair of spaced apart walls.

4. The bin divider of claim 1, wherein said bridge portion is sized to have said first portion and said second portion be in physical contact with the rear wall of the bin on both sides thereof.

5. The bin divider of claim 1, wherein said bin divider is made of a plastic material.

6. The bin divider of claim 1, wherein said divider plate is of a size for extending from the rear wall to the front wall on the inside of the bin.

7. A combination bin and bin divider for a door of a storage compartment, comprising:

a bin constructed for being mounted on an inside wall of a storage compartment with an outside rear wall of the bin spaced from the inside wall of the door, said bin having one of a tongue and groove extending horizontally at least along a portion of the length of the outside of a rear wall thereof; and at least one moveable bin divider mounted in said bin, and comprising a divider plate of a size extending a length from an inner rear wall of the bin to divide the bin into storage sections; a panel integral with said divider plate, and perpendicular to the divider plate; said panel having a first portion extending vertically at least a height above a rear wall of the bin, a bridge portion extending over a rear wall of the bin and connecting a second portion of the panel to the first portion thereof to have the second portion parallel with and coextensive with at least a part of the first portion on the outside of the rear wall of the bin, said second portion terminating at a bottom end thereof in one of a tongue and groove integral therewith engaging correspondingly to said one of a tongue and groove extending along the outside of the rear wall of the bin and the first portion having a height at least as great as the height of said divider plate.

8. The combination of claim 7, wherein said one of a tongue and groove at said end of said second portion is a tongue, and said one of a tongue and groove on the outside of the rear wall of said bin is a groove, said groove being formed by a pair of spaced apart walls each extending interiorly of the outside surface of the rear wall of the bin and a base extending to and between said pair of spaced apart walls.

9. The combination of claim 7, wherein said one of a tongue and groove at said end of said second portion is a groove, and said one of a tongue and groove on the outside of the rear wall of said bin is a tongue.

10. The combination of claim 7, wherein said bridge portion is sized to have said first portion and second portion be in physical contact with the rear wall, on both sides thereof, of the bin.

11. The combination of claim 7, wherein said bin divider is made of a plastic material.

12. The combination of claim 7, wherein said divider plate is of a size for extending from the rear wall to a front wall on the inside of the bin.

* * * * *